United States Patent [19]

Imral et al.

[11] 4,236,381

[45] Dec. 2, 1980

[54] SUCTION-LIQUID HEAT EXCHANGER HAVING ACCUMULATOR AND RECEIVER

[75] Inventors: Sadik S. Imral, St. Louis; Asadulla R. Khan, Ballwin, both of Mo.

[73] Assignee: Intertherm Inc., St. Louis, Mo.

[21] Appl. No.: 14,577

[22] Filed: Feb. 23, 1979

[51] Int. Cl.[3] ..... F25B 29/00

[52] U.S. Cl. ..... 62/324R; 62/503; 62/513

[58] Field of Search ..... 62/503, 509, 513, 324

[56] References Cited

U.S. PATENT DOCUMENTS

| | | | |
|---|---|---|---|
| 3,084,523 | 4/1963 | Bottom et al. | 62/503 |
| 3,246,482 | 4/1966 | Harnish | 62/503 |
| 3,837,177 | 9/1974 | Rockwell et al. | 62/503 |
| 4,106,307 | 8/1978 | Matsuda | 62/503 |
| 4,111,005 | 9/1978 | Livesay | 62/503 |

*Primary Examiner*—Ronald C. Capossela
*Attorney, Agent, or Firm*—Jerome A. Gross

[57] ABSTRACT

A suction-liquid heat exchanger for a heat pump is provided by utilizing an inner vessel as a suction line accumulator together with a surrounding high pressure outer vessel which is utilized as a receiver in the liquid line. Heat from the liquid refrigerant in the outer vessel is transferred to the cooler liquid accumulated in the inner vessel to vaporize it, preventing slugs of liquid refrigerant from entering the compressor. The exit and entry ports of the outer vessel are at different levels. This causes a greater amount of liquid refrigerant to remain in the outer vessel on heating mode operation than on reverse flow for cooling, thereby increasing the heat transfer to the accumulator as required for the greater volume of liquid in the suction line gas and compensating for the decreased quantity of refrigerant needed for heating.

2 Claims, 3 Drawing Figures

SUCTION-LIQUID HEAT EXCHANGER HAVING ACCUMULATOR AND RECEIVER

BACKGROUND OF THE INVENTION

The present invention relates to vapor compression refrigeration apparatus, particularly for systems capable of reversible operation for heating and cooling, commonly known as heat pumps.

Some vapor compression refrigeration systems utilize a reservoir, known as a receiver, which stores liquid drained from the condensing coils prior to its introduction into the evaporator through a throttling device. The receiver serves to contain excess refrigerant charge in the system, which otherwise might occupy a portion of the condenser.

Some vapor compression refrigeration systems include an accumulator in the suction line to trap incompressible liquid refrigerant slugs contained in the suction line gas, which could damage the compressor, either by breaking a piston or valve or by entering the crankcase via the oil return and "washing" the bearings of oil. The accumulator may also be utilized to aid in returning oil in the suction line gas (that has been trapped with the suction line liquid) to the compressor crankcase.

Protection of the compressor and valves is sometimes effected by a heat exchanger which drains off liquid from the suction line gas, vaporizes it in a coil by heat exchange with the hot liquid in the liquid line, and reintroduces the vapor to the suction line. For proper operation, an oil trap or separator must also be provided.

In heat pumps, throttling may be performed by two sets of capillary tubes, one for cooling and one for heating. Check valves are used to direct flow through the proper set of capillary tubes for heating and cooling. However, a single two-way throttling valve is sometimes used for both the heating and cooling modes.

Liquid-suction heat exchangers were formerly utilized with some refrigerants, such as R-12, to subcool the liquid refrigerant before entering the evaporator by heat exchange with the cooler suction line gas, increasing evaporator efficiency. For refrigerants now universally utilized in modern heat pump systems, mainly R-22 and R-502, which decrease substantially in density when heated in this temperature range, heat exchangers of this type are not used. They would not significantly improve efficiency because the resultant heating of the suction line gas greatly decreases the density to lessen the compressor capacity, offsetting any increase in evaporator efficiency.

SUMMARY OF THE INVENTION

An object of the present invention is to provide a multi-compartmented device, of a minimum size, which will function in a vapor compression heat pump system to vaporize any liquid refrigerant present in the suction line gas, particularly during the heating cycle in which the problem is otherwise a serious one, without loss of efficiency of the system as a whole. Another object is to receive liquid refrigerant draining from the condenser, and to store a portion of the refrigerant during the heating cycle when a lesser quantity is required. Further objects will be apparent from this disclosure.

These objects and others are achieved by providing an accumulator in the suction line to temporarily trap any liquid refrigerant or oil and to forward the gas refrigerant and the oil to the compressor. Surrounding the accumulator is an outer high-pressure vessel jacket coupled to the liquid line, which serves in part as a receiver. Heat exchange from the warm liquid in the jacket to the cooler liquid in the accumulator vaporizes any accumulated liquid within, which is then drawn into the compressor. In the receiver jacket, the port leading to the outdoor coil is at a vertical level above the port leading to the indoor coil. On operation in the heating mode, the liquid enters by the lower port and exits by the upper port, causing a greater portion of liquid refrigerant to be contained than for the cooling mode, when flow is reversed. This greater volume of refrigerant functions both to vaporize the greater amount of liquid in the suction line gas in the heating mode, thus protecting the compressor, as well as to reduce the effective refrigerant charge for the decreased capacity required for heating. During the cooling mode, when the suction gas is warmer and thereby contains less liquid refrigerant, the lower level of liquid then contained in the outer vessel effects less heat exchange to the suction gas and leaves a larger effective refrigerant charge for the greater capacity required for cooling.

Alternatively, where a two-way throttling valve is utilized between the receiver and outdoor coil so that the liquid in the receiver in the cooling mode is quite cold, its lower port is preferably positioned at the bottom of the receiver, keeping it empty during the cooling mode, so that no heat exchange is effected.

When the present accumulator-receiver is utilized as a heat exchanger in heat pumps with modern refrigerants, such as R-22 or R-502, it may provide little increase in efficiency, but functions to eliminate harmful slugging, particularly in the heating mode, and varies the effective refrigerant charge as required for effective heating and cooling operations.

DESCRIPTION OF THE PREFERRED EMBODIMENT

Figures 2, 3:
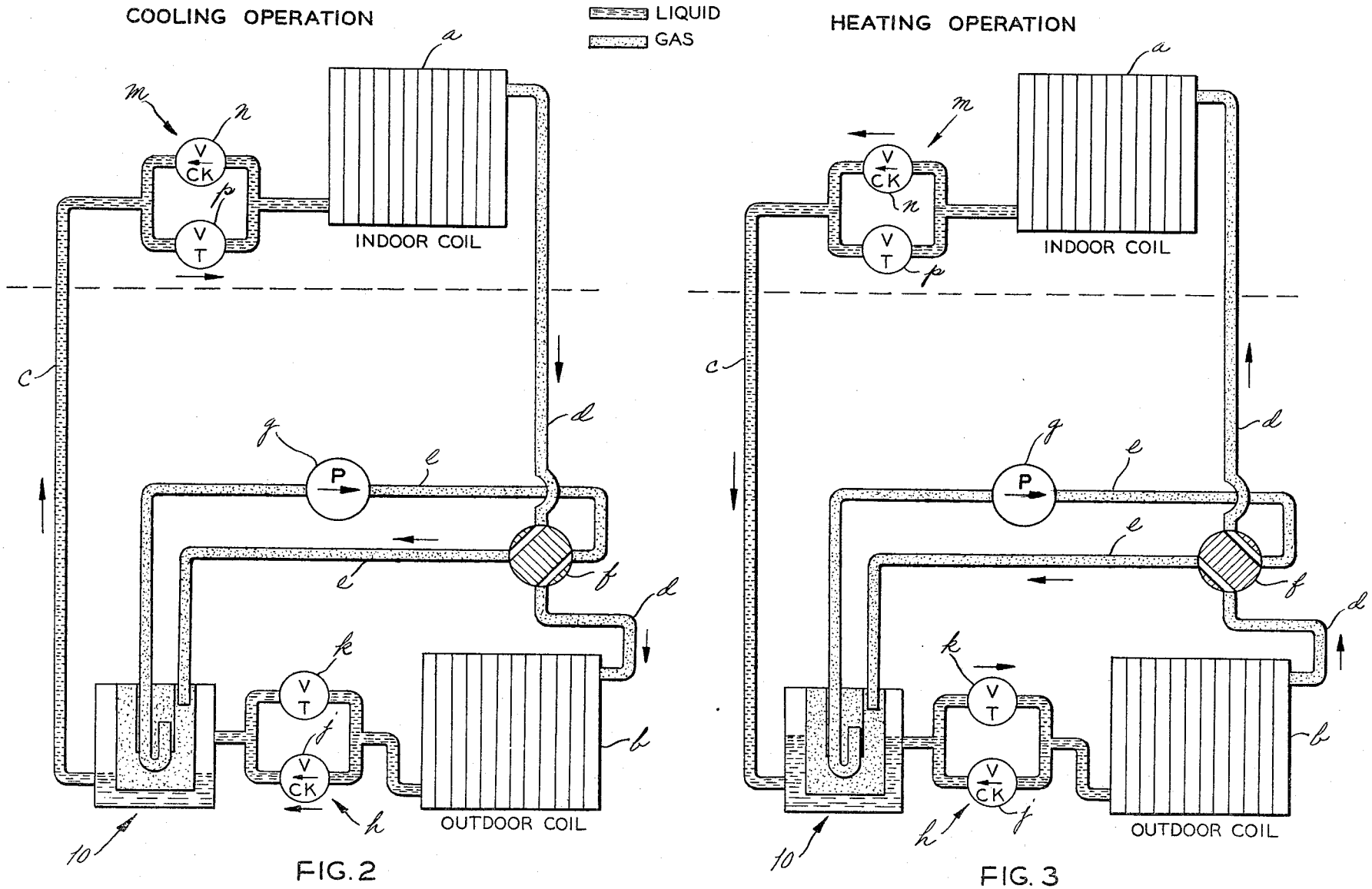
FIG. 2 is a schematic view of a heat pump system including the present invention, shown during cooling operation.
FIG. 3 is a view similar to FIG. 2 shown during heating operation.

The present suction-liquid heat exchanger having a combined accumulator-receiver is utilized in a conventional heat pump system, shown schematically in FIGS. 2 and 3. The heat pump system utilizes a conventional indoor or inside coil a, located within the premises to be heated or cooled. Likewise, a conventional outdoor or outside coil b is utilized, located out of doors or outside the premises to be heated or cooled, in the heat pump cabinet. The indoor and outdoor coils a, b each have a lower inlet and an upper inlet, one inlet serving as an outlet, depending upon the direction of flow of refrigerant through the coils a, b.

the indoor and outdoor coils a, b are joined or coupled by their lower inlets by a liquid refrigerant line c and the upper inlets of the coils a, b are joined or coupled by a suction line d. The suction line d includes a suction line loop e in the outdoor cabinet connected into the suction line d by a four-way reversing valve f. A compressor g, of the hermetically-sealed reciprocating-piston type, is included in the loop e, as shown in FIGS. 2 and 3.

At the lower inlet to the outdoor coil, the liquid line c has an outdoor throttling assembly h split into two parallel flow paths, the first having a check valve j and the second having a throttling device k, which may be a set of capillary tubes or a thermostatic expansion valve. The sense of check valve j is such that flow from the outdoor coil to the indoor coil is through the check valve j and opposite flow is through the throttling device k.

At the lower inlet of the indoor coil a, a similar throttling assembly m, including a parallel check valve n and throttling device p, is interposed in the liquid line c, in such sense that liquid line flow from the indoor coil a to the outdoor coil b is through the check valve n and opposite flow is through the throttling device p.

Figure 1:
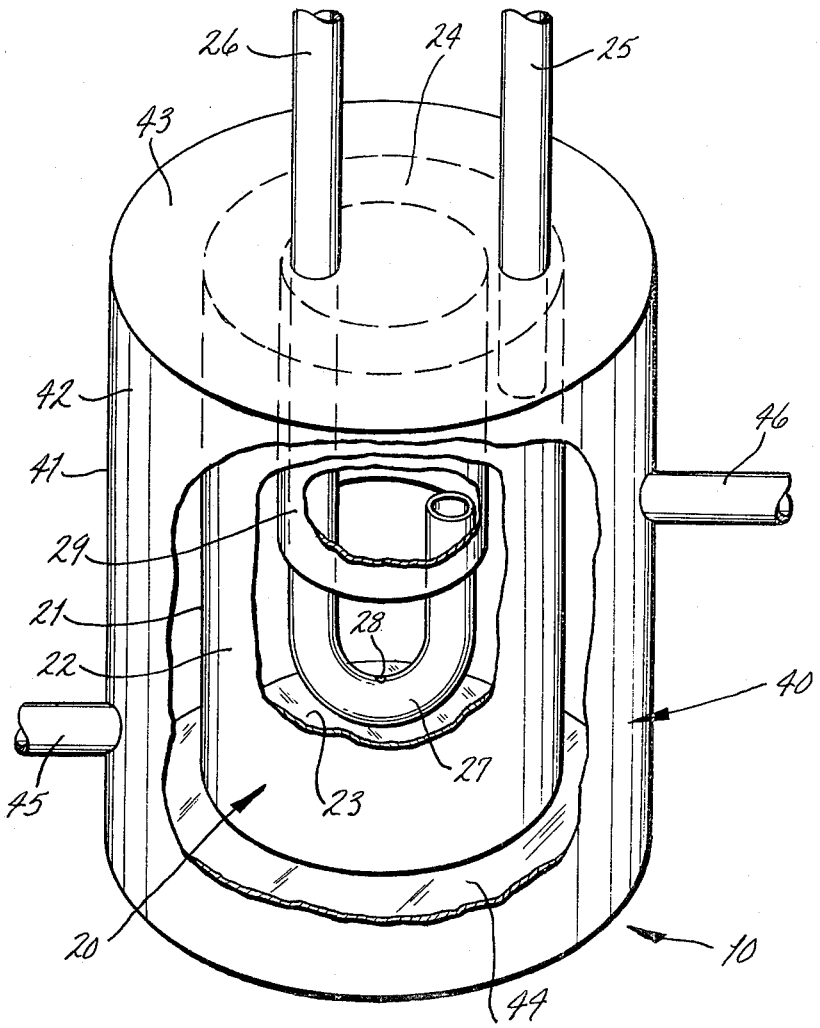
FIG. 1 is a cabinet projection of apparatus embodying the present invention with the outer vessel, inner vessel and inner baffle partially broken away.

The present invention, shown in FIG. 1, is a combined accumulator-receiver forming a suction-liquid heat exchanger utilized in the above described heat pump system installed in the outdoor cabinet. The suction-liquid heat exchanger, generally designated 10, includes an inner vessel or accumulator, generally designated 20, interposed in the suction line loop e between the four-way valve f and the inlet side of the compressor g. The heat exchanger 10 also includes an outer vessel, generally designated 40, coupled in the liquid line c between the indoor throttling assembly m and the outdoor throttling assembly h.

The inner accumulator vessel 20 has a cylindrical enclosed casing 21, including a cylindrical side wall 22, a circular bottom 23 and a circular top 24. Inside the casing 21, a cylindrical baffle 29 is spaced inward of the cylindrical side wall 22 and extends downward from the top 24 to a level lower than the mid-height of the casing 21. An inlet tube 25 extends downward through the vessel top 24 outward of the baffle 29. Within the baffle 29, an outlet tube 26 extends downward through the vessel top 24 to a lower U-shaped portion 27 which extends below the lower end of the baffle 29 and returns upward to an open end above the lower end of the baffle 29. At the lowermost end of its U-shaped portion 27, the outlet tube 26 has an upper oil orifice 28.

The outer vessel 40 forms a receiver or jacket about the inner vessel 20; it has a casing 41 constructed to withstand the high pressures of the liquid refrigerant line c, which may be 250 psi. The casing 41 is made up of a cylindrical side wall 42 spaced radially outward of the inner vessel side wall 22, a top 43 formed with the inner vessel casing top 24, and a bottom 44 below and adjacent to the inner vessel bottom 23. The inner vessel top 24 and outer vessel top 43 may be welded together or formed as a single element. The cylindrical side wall 42 of the outer vessel 40 has a pair of refrigerant passage ports sized to permit coupling the outer vessel into the liquid line c. Of the two ports, the lower port 45 is located in the side wall 42 spaced slightly above the level of the inner vessel bottom 23. The upper port 46 is located substantially above the level of the inner vessel bottom 23, in this embodiment, approximately mid-way up the outer vessel side wall 42.

In use of the suction-liquid heat exchanger 10, as shown in FIGS. 2 and 3, the outer vessel 40 is coupled into the liquid line c outdoors with its upper port 46 coupled to the outdoor throttling assembly h on its side opposite its connection to the outdoor coil b. The outer vessel lower port 45 is coupled by the liquid line c to the indoor throttling assembly m on its side opposite its connection to the indoor coil a. The inner vessel 20 is coupled into the suction line loop e, its inlet tube 25 to the four-way reversing valve f, and its outlet tube 26 to the inlet of the compressor g.

For cooling mode operation of the heat pump system with the present invention installed, as shown in FIG. 2, refrigerant flow occurs through the liquid line c from the outdoor coil b to the indoor coil a and the suction line d from the indoor coil a to the outdoor coil b. As is well known, the liquid line c carries a high-pressure liquid refrigerant which was condensed in the outdoor coil b and may be at a temperature of approximately 115° F., assuming an outdoor ambient air temperature of 90° F.

The suction line d carries refrigerant which is substantially gas, having been evaporated in the indoor coil a. Refrigerant temperature is approximately 65° F., where the ambient indoor air temperature is about 80° F. This refrigerant is shunted into the suction line loop e where it passes into the accumulator vessel 20 of the heat exchanger 10 by the inlet tube 25. This flow is caused by the compressor g drawing refrigerant out of the accumulator 20 through the U-shaped outlet tube 26. As it flows, the refrigerant is accelerated as it is drawn around the lower end of the baffle 29, causing any liquid refrigerant or oil particles in the refrigerant to fall to the bottom of the accumulator 20; only gas refrigerant is drawn into the open end of the outlet tube 26.

Further, during cooling the liquid flow through the outer receiver vessel 40 is from its upper port 46 to its lower port 45. With the heat pump system properly charged with refrigerant, the level of the liquid refrigerant in the outer vessel 40 is then at about the level of the lower port 45, contacting a portion of the lower end of the inner vessel 20. Thus, a small amount of heat is exchanged from the hot liquid in the outer vessel 40 to the liquid accumulated at the bottom of the inner vessel 20. This may cause liquid entrapped in the inner vessel to vaporize; the vaporized refrigerant is then drawn into the compressor d through the inner vessel outlet tube 26.

Oil which has escaped from the compressor and circulated through the system floats on the liquid refrigerant accumulated in the inner vessel 20. Should such escaped oil reach the height of the oil orifice 28, it will be drawn downward into the outlet tube 26 and then into the compressor g, where it is returned to the crankcase.

For heating mode operation, the four-way valve f is switched to provide reverse refrigerant flow. The flow in the liquid line c is then from the indoor coil a to the outdoor coil b and the suction line d is from the outdoor coil b to the indoor coil a. The refrigerant in the liquid line is a warm high-pressure liquid, at about 80° F., assuming a 70° F. indoor ambient temperature, and the refrigerant in the suction line is, after leaving the outdoor coil b, a cold low-pressure gas at approximately 30° F. where the outdoor temperature is 30° F. This cold suction line refrigerant, as it is drawn into the accumulator, may contain a substantial quantity of liquid, often called refrigerant "slugs". Such liquid refrigerant is accumulated in the lower end of the inner vessel 20 as described for the cooling operation, along with any circulated oil.

Since the refrigerant flow in the liquid line c is from the indoor coil a to the outdoor coil b, the flow through the outer receiver vessel 40 is from the lower port 45 to the upper port 46. Thus, where the heat pump system is properly charged with refrigerant, liquid refrigerant is contained by the outer vessel 40 up to the level of the upper port 46. This bathes the side wall 22 of the inner vessel 40 with warm liquid refrigerant, which when it enters the receiver 40 is at approximately 80° F. Considerable heat exchange occurs from the warm liquid in the outer receiver 40 to the cold liquid accumulated at the bottom of the accumulator 20. After this heat exchange, the temperature of the refrigerant in the suction line loop e as it is drawn from the accumulator to the compressor g is approximately 60° F., and a large quantity of the liquid which would otherwise remain accumulated in the lower end of the inner vessel 20 is vaporized.

In the heating operation, containment of the greater quantity of liquid refrigerant in the outer receiver vessel 40 serves still another purpose. For most efficient operation of the heat pump system, a lesser quantity of refrigerant is required in the heating mode than in the cooling mode. By containing more liquid refrigerant in the receiver 40 on heating mode operation than on cooling mode operation, an effective reduction is realized in the amount of refrigerant used for heating, while the greater amount required for cooling is, on reverse flow, present and available.

If one of the fluorocarbon refrigerants commonly used in the past, such as R-12, is utilized as the refrigerant in a heat pump system utilizing a suction-liquid heat exchanger, the resultant sub-cooling of the liquid line refrigerant improves the efficiency of the evaporating coil into which it flows. These refrigerants, such as R-12, have been almost entirely replaced in favor of other fluorocarbon refrigerants, such as R-22 and R-502, which have a much greater net refrigeration effect than R-12. With the use of refrigerants of this class, the resulting heat transfer to the suction line gas substantially decreases its density with a resulting decrease in the compressor capacity, since it must pump refrigerant of a lower density. Since the decreased compressor capacity will generally offset any increase in evaporator efficiency, incorporation of a suction-liquid heat exchanger in a modern heat pump system utilizing a refrigerant of this new class would not seem to be especially beneficial.

However, in other ways the benefits afforded by use of the present invention, even with the modern refrigerants, such as R-22 and R-502, are significant. Liquid refrigerant slugs must be removed from the suction line loop e before being drawn into the compressor g. If any substantial amount of the incompressible liquid refrigerant should reach the compressor, it is almost certain to break a compressor piston or valve. Furthermore, if this liquid should accumulate in the compressor crankcase; it might reach a sufficient level to wash the oil from the crankshaft bearings. Using the present invention, the heat transfer to the inner accumulator 20 insures that its liquid level will be minimal.

Further, by the vertically offset receiver vessel refrigerant passage ports to cause containment of a greater quantity of refrigerant on heating operation, two advantages are gained: more heat transfer to the colder suction line refrigerant, and an effective reduction of excess refrigerant charge needed for cooling, but not needed for heating. Another advantage of the present invention is that it provides an accumulator with an oil return and a receiver together in a unitary package that is easily accommodated within the confines of a crowded heat pump cabinet.

A slightly modified embodiment of the present invention is ideally suited for use in a heat pump system in which throttling is done by a single two-way throttling valve placed in the liquid line adjacent to the outdoor coil. In the heating mode, operation would be identical to that described above; but in the cooling mode, the temperature of the liquid line refrigerant would be much cooler, on the order of 50° F. Any heat exchange would then be from the inner vessel to the outer vessel, an undesirable effect. To eliminate the heat exchange, the lower port 45 of the outer vessel 40 would be provided at the level below the bottom 23 of the inner vessel 20. With the heat pump system properly charged with refrigerant, no liquid refrigerant in the outer vessel will then contact the inner vessel side wall 22 or bottom 23, and little or no heat exchange can occur. By this modification, using such a two-way throttling valve, a significant amount of heat exchange occurs on heating, when liquid refrigerant is almost certainly present in the suction line, but little or no heat exchange occurs on cooling.

Other modifications of the present invention will be obvious to persons skilled in the art. For example, any configuration of an accumulator and a receiver having a common wall and appropriately positioned ports may be used to effect the desired heat exchange. For the accumulator vessel, other internal apparatus may be utilized to cause entrapment of the liquid refrigerant present in the suction line. From these examples and the above described embodiment, other modifications will suggest themselves.

We claim:

1. For use in a vapor compression heat pump system having indoor and outdoor refrigeration coils coupled by a liquid refrigerant line having a pair of throttling assemblies and by a suction refrigerant line having a compressor and a reversing valve, a suction-liquid heat exchanger comprising an outer high-pressure vessel having for coupling in the liquid refrigerant line between such pair of throttling assemblies, a first lower port spaced upwardly from the vessel lower end, and a second upper port displaced upward from the first port, in combination with an inner liquid-accumulating closed vessel extending downward within the outer vessel to a lower end at a level below the outer vessel lower port, and having, for coupling in the suction line, an upper inlet, and a suction outlet tube having an open end spaced above the lower end of the inner vessel, whereby, upon coupling the inner vessel in the suction line and the outer vessel in the liquid line, with its lower port coupled by one throttling assembly to the indoor coil and its upper port by the other throttling assembly to the outdoor coil, on cooling operation when liquid line refrigerant flow is from the upper port to the lower port, the liquid refrigerant level in the outer vessel is normally above the level of the lower end of the inner vessel and substantial heat is exchanged, though less than on heating operation.

2. A vapor compression heat pump system comprising an indoor refrigeration coil, an outdoor refrigeration coil, a suction refrigerant line having therein a compressor and a reversing valve which causes liquid line refrigerant flow from the indoor coil to the outdoor coil for heating operation and opposite flow for cooling operation, a liquid refrigerant line coupling said coils, said liquid line including two throttling assemblies, each having a parallel throttling device and check valve and so connected that the throttling device of the throttling assembly nearer the indoor coil is effective on cooling operation and the throttling device of the throttling assembly nearer the outdoor coil is effective on heating operation, and further comprising a suction-liquid heat exchanger including a high-pressure receiver vessel coupled in the liquid refrigerant line between said pair of throttling assemblies by a first lower port coupled by one of said throttling assemblies to the indoor coil, and by a second upper port displaced upward from the first port and coupled by the other of said throttling assemblies to the outdoor coil, the heat exchanger further including a liquid-accumulating closed vessel having common side wall means with said receiver vessel, said common side wall means extending downward to a level below the receiver vessel lower port, the liquid-accumulating vessel being coupled in the suction line by an inlet coupled to the outdoor coil and a suction outlet tube coupled to the compressor, whereby, on cooling operation, when liquid line refrigerant flow is from the upper port of the receiver vessel to its lower port and the throttling device of that throttling assembly nearer the outdoor coil is ineffective, liquid refrigerant may be contained to about the level of the lower port, and heat is exchanged from the receiver vessel across said common side wall means to said liquid-accumulating vessel in a quantity which is substantial, though less than on heating operation.

* * * * *